United States Patent [19]

Cobelli

[11] 4,151,707

[45] May 1, 1979

[54] WATER PROOF WATCH

[75] Inventor: Mario Cobelli, Milan, Italy

[73] Assignee: Multibrev Anstalt, Vaduz, Liechtenstein

[21] Appl. No.: 815,554

[22] Filed: Jul. 14, 1977

[30] Foreign Application Priority Data

Jul. 26, 1976 [CH] Switzerland ..... 9541/76

[51] Int. Cl.[2] ..... G04B 27/02; G04B 3/04; G04B 37/08

[52] U.S. Cl. ..... 58/63; 58/84; 58/85.5; 58/88 B; 58/90 B

[58] Field of Search ..... 58/88 R, 88 B, 90 R, 58/85.5, 81, 63, 80, 84, 90 B, 28 D; 200/156

[56] References Cited

U.S. PATENT DOCUMENTS

| | | | |
|---|---|---|---|
| 2,308,189 | 1/1943 | Marti | 58/90 R |
| 2,582,706 | 1/1952 | Kudelski | 58/90 R |
| 2,950,372 | 8/1960 | Aspinwall | 200/156 |
| 2,967,222 | 1/1961 | Bentley | 200/156 |
| 3,048,301 | 8/1962 | Arpin | 58/90 R |

*Primary Examiner*—Edith S. Jackmon
*Assistant Examiner*—C. Hart

[57] ABSTRACT

A water-proof watch which comprises a composite watch case and a movement therein, said case consisting of a transparent plastic face crystal having overmolded therein a generally opaque plastic body portion to which can be fitted a plastic closure portion sealable after the movement is placed in the watch. At least a zone of the case or of the closure portion is flexible in order to provide control of the winding and regulating mechanism of the movement.

5 Claims, 8 Drawing Figures

WATER PROOF WATCH

This invention relates to a water-proof watch. More particularly, the invention relates to a water-proof watch case which is relatively inexpensive to manufacture from commonly available materials and which could be easily manufactured on a continuous production basis, in conjuction with a watch "movement" which has thereon parts of control and command suitably modified as to be able to operate properly within said case.

In the following it is to be noted that by the term "movement" it is meant any types of already known means used in the measure of time, be they mechanical, electrical or electronic.

In general, when producing a watch which will be water-proof and which will withstand a certain amount of water pressure, there are three points of weakness which must be carefully considered when the design is effected. The first point is the junction point between the glass and the case body. This is a very important weakness point inasmuch as the coefficients of expansion of the glass and of the case, which is usually made of metal, are completely different. Therefore, this necessitates the use of an extremely efficient gasket. The second point is the one at which the watch stem enters the case itself. Also at this point, gasketing is needed to prevent water leakage. The third point is the seal which is effected, after the complete working unit of the watch is inserted in the case, between the back portion of the watch case and the case itself.

As is obvious to one skilled in the art, the gaskets used, which are necessarily made of a resilient rubber or plastic material, tend to deteriorate due to aging, or due to exposure to adverse conditions. Such deterioration, which may be unnoticeable to the user, would lead, if the watch is immersed in water or used during swimming, underwater activities or the like, to a water leakage therein which would inevitably lead to rusting or similar damage of the working mechanism.

Hermetically sealed watches have been previously proposed, which should ensure a permanent hermetic closure at the above specified three locations. In order to ensure a hermetic closure between the watchcase and "glass," the Swiss Pat. No. 180,108 provides to cast a non transparent plastic mass or material against the edge of a disc of transparent material, which plastic material will after curing or setting sealingly surround the disc contour. The mass or material surrounding the disc forms a part of the watchcase. The solution does not allow to ensure hermetic closure, particularly in time, since the connection between the disc and mass or material is committed to adherence between the two materials, rather than to an interpenetration coupling of the two materials. Particularly should the two materials have different characteristics, for example different coefficients of thermal expansion, separations could appear along the contacting surfaces with a resulting loss of hermetic closure. In U.S. Pat. No. 3,797,875 there is disclosed an electronic watch, wherein to control time setting a contact internally of the case is provided and a contact spring operated by a flexible membrane or diaphragm is cooperative therewith, this membrane being supported by the watchcase. Particularly, an opening is provided in the case and has a step against which said contact spring abuts. The flexible membrane adheres on the spring and a retainer ring blocks the assembly in said opening. The solution ensures hermetic closure at this location of the watchcase. However, it requires the use of three distinct pieces or elements (contact spring, membrane and retainer ring) and necessarily manual or mechanical operations for application thereof.

The British Pat. No. 727,138 discloses an automatic watch, the movement of which is entirely enclosed within a plastic envelope, permanently sealed and transparent at the face dial. The plastic envelope is placed within an outer metal case and has an elastically deformable zone at which the metal case carries a control or drive mechanism that through such a zone serves for imparting the required controls of time setting to the movement. The control or drive mechanism is fitted with a seal for preventing water seepages that would damage it. However, the seal tends to deteriorate by aging or exposure to adverse conditions with a resulting damage to such a mechanism. The plastic envelope comprises two parts, the contours of which are bevelled so that they can be nested in each other. This solution should necessarily comprise two envelopes, that is an internal plastic envelope for accommodating the movement, and an external metal envelope for carrying the drive or control mechanism, and is therefore expensive and complicated.

It is an object of the present invention to provide a watch having a tight sealed case, which over conventional solutions has a time guaranteed hermetic closure, is of an easy construction, has all of its parts properly protected against moisture action and of economical production.

The above object is attained by an hermetically closed watch, comprising a case of plastic material including a transparent portion fast with a first portion of the case and a second portion sealable to the first portion and closing the latter, and at least one flexible zone for controlling at least the time setting of the watch movement, characterized in that said flexible zone comprises a membrane button of flexible plastic material fast with and overmolded to the case.

The invention will be more clearly understandable with reference to the appended drawings in which.

Figure 1:
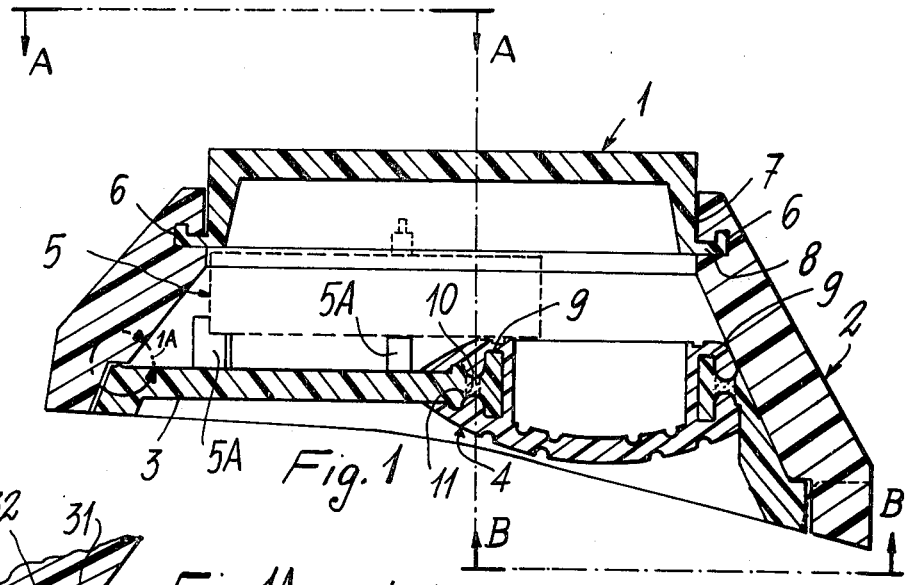
FIG. 1 is a side sectional view of an embodiment of the present invention.
Figure 1A:
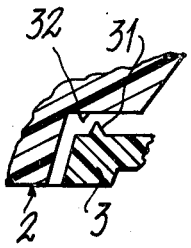
FIG. 1A is an enlarged sectional view showing the detail within the circle of FIG. 1.
Figure 2:
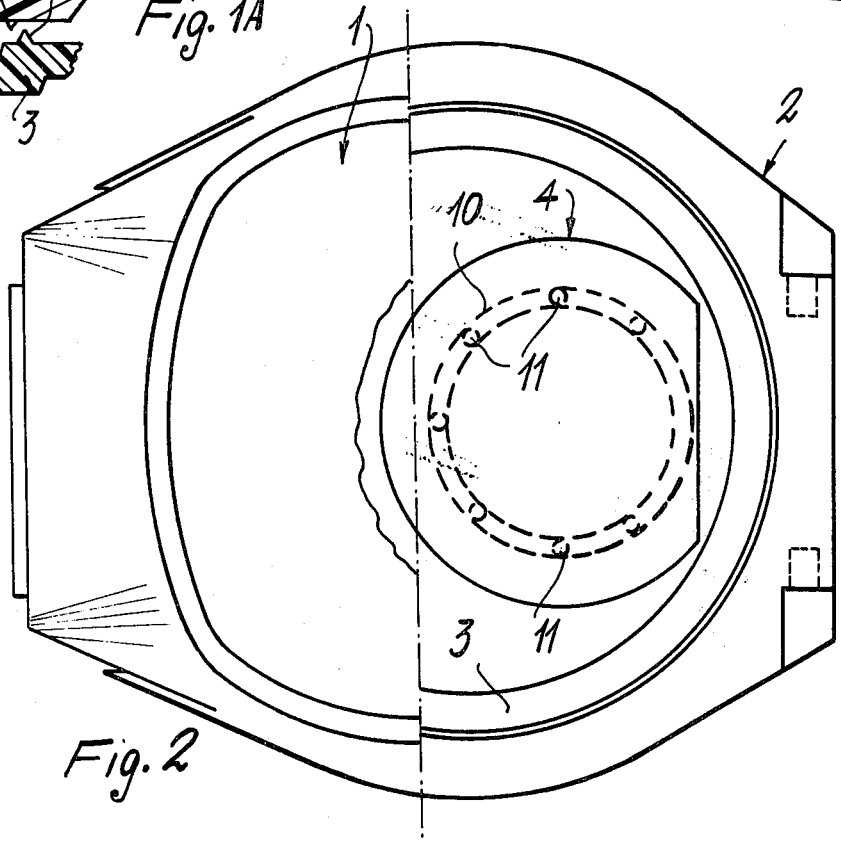
FIG. 2 is composite plan view of the embodiment of FIG. 1 showing, on the left side, a partial top view 1 taken from A—A in FIG. 1 and, on the right side, a partial bottom view taken from B—B in FIG. 1.

Referring now to the drawings, FIG. 1 shows a transparent plastic watch crystal 1 a watch body 2, a back portion 3 and a button 4 extending from said back portion. In FIG. 2, a portion is cutway to show button 4 in its entirety. The working mechanism 5 of the watch is shown in FIG. 1 in segmented lines.

The watch crystal 1 is constructed of substantially shock-resistant transparent plastic material of suitable hardness. The body 2 and back 3 can be constructed of the same material, with a suitable coloring agent added usually thereto for aesthetic purposes.

For the transparent section, there have been considered materials which, in addition to a perfect transparency, have also good resistance to abrasion and to scratching. Such materials are acrylic polymers in general, polycarbonate, aromatic polyamides and polyethyleneterephthalate.

The materials utilized for the production of the case and bottom should have both good aesthetic properties as well as good mechanical properties, such as, resistance to impact, to abrasion, to fats, to perspiration, and the like. Another important factor to consider in the choice of such materials is substantially the same physical characteristics, such as coefficient of expansion, as the material employed in the fabrication of the transparent portion. Materials found suitable are acrylic polymers in general, acrylonitrilebutadiene-styrene (ABS) copolymers, polybutyleneterephthalate, polyethyleneterephthalate, polycarbonate, polyacetals and their copolymers, polyamides and the like.

The button which is usually located at the bottom of the case and which, for reasons which will become more apparent from the description of the entire setting and winding operations which follows hereinafter, must be of a flexible nature, is prepared from an elastomeric plastic material. Such material must be capable of withstanding repeated stresses, have high resistance to tearing, good dimensional recovery ability, high degree of flexibility, good resistance to abrasion, to fats and to oils.

It is therefore preferred to choose said material from the thermoplastic elastomers belonging to the groups of copolyesters, polyurethanes, olefinic copolymers or styrene-olefin-styrene block copolymers.

The composite case assembly is preferably produced as follows: plastic crystal portion 1 is produced by injection molding from a suitable transparent material. Body portion 2 is then overmolded on said transparent portion 1 as to provide an integral unit therewith.

Bottom 3 is produced by injection molding, preferably from the same material used for body 2. Button 4 is then overmolded on bottom 3.

Aside from the fact that body 2 is overmolded on portion 1 and consequently becomes an integral part therewith, it is to be noted that the configuration of the border of the transparent portion 1 and the upper portion of body 2 enhance the obtaining of the most durable and waterproof juncture. The coacting of annular flange 6 in portion 1 with the corresponding female groove in body 2 which forms during overmolding and the mating of the annular flange 7 which is similarly formed on body 2 with the corresponding female groove on part 1, add to to the structural strength of the unit.

The waterproof seal of the button 4 on the bottom 3 is obtained by providing on the bottom, surrounding the circular hole which is to be occupied by the botton, an annular section 9 having a thickness larger than the average thickness of said bottom. Immediately surrounding said annular section 9 there is provided a circular section 10 of reduced thickness with respect to the average thickness of said bottom, having thereon a plurality of holes 11 extending therethrough.

During the overmolding operation, the molten plastic is forced into the suitable mold and consequently through holes 11. Upon solidification, the plastic portions extending through said holes will integrally connect the upper and lower sections of the button. This, plus the sealing action effected by the plastic which enters the grooves defined by annular section 9 and reduced circular section 10, renders the seal between bottom and button essentially liquid-proof.

Mechanical, electric or electronic (movement) section 5 is centered by projections 5A of bottom 3.

After the mechanical portion of the watch is introduced in the case, the bottom is sealed onto the body by conventional means, such as ultrasonic welding, by heating or by mechanical means.

Preferably, the bottom 3 has thereon an annular raised section 31 which, during the heat sealing process, melts, resulting in the sealing of the bottom 3 to the body 2 of the case.

In case it is necessary to open the watch for reasons of reparations or other, the bottom can be removed and discarded and, after having properly smoothed the border 32, a new bottom 3 can be applied thereon.

Figure 3:
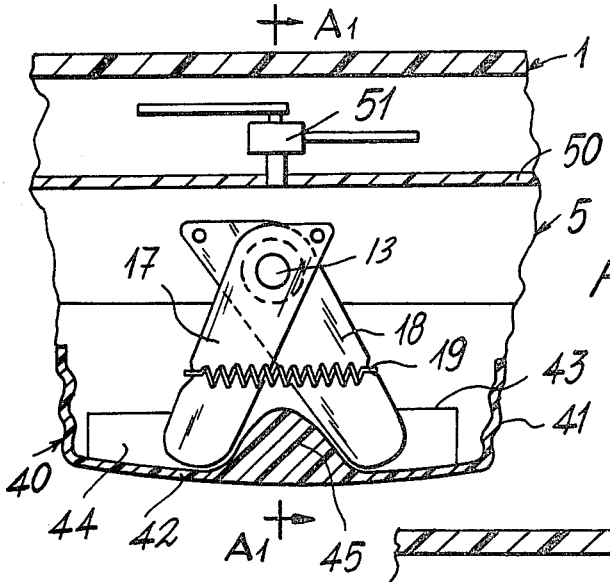
FIG. 3 is a partial sectional view of the working and winding mechanism of the watch.
Figure 4:
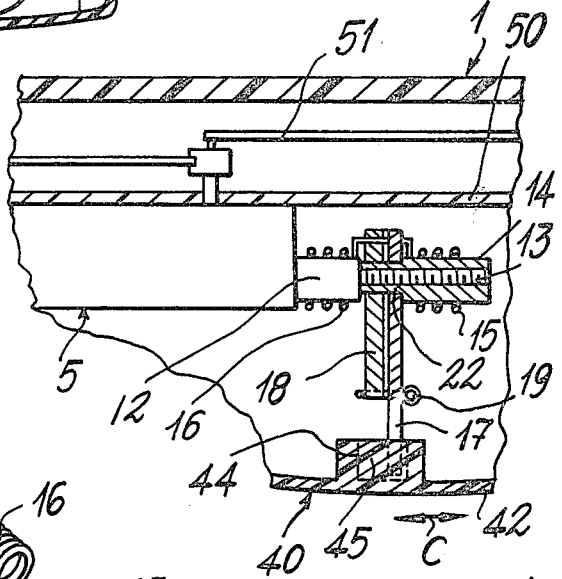
FIG. 4 is partial sectional view of the working and winding mechanism taken along line $A_1$—$A_1$ of FIG. 3.
Figure 5:
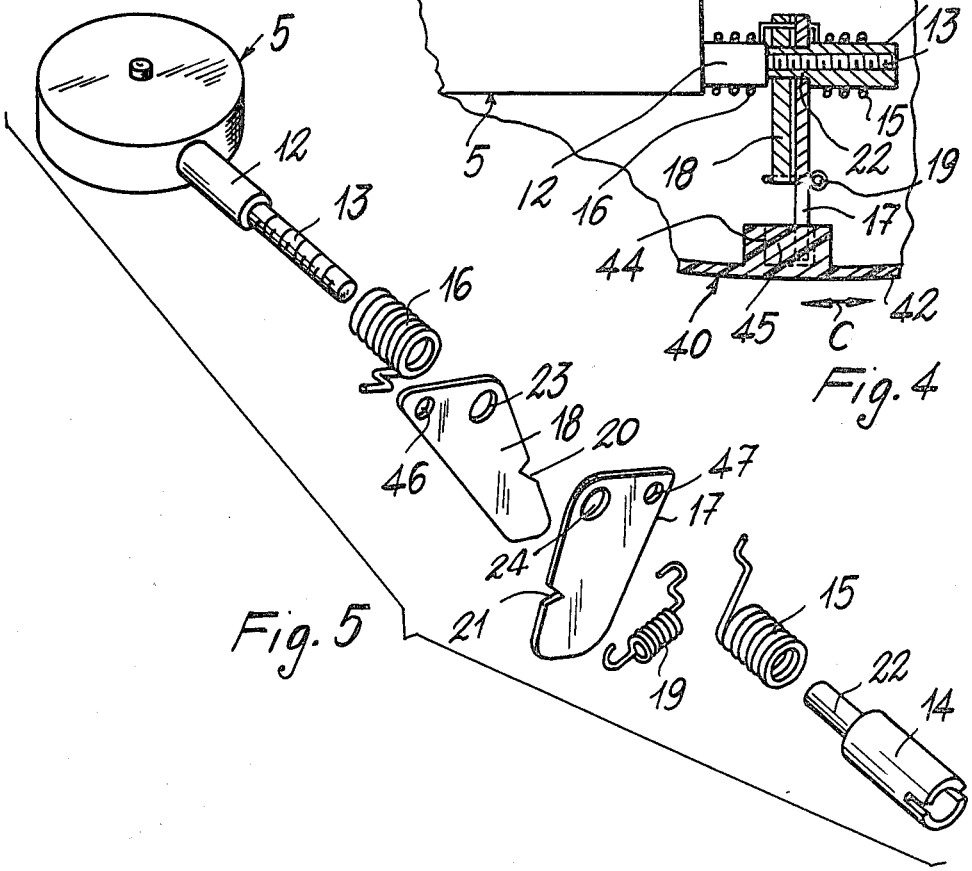
FIG. 5 is a view showing the components of the working and winding mechanism in a disassembled and blown-up form.

FIGS. 3, 4 and 5 show by way of example a winding and time setting mechanism for use in a watchcase made according to the teachings of the invention in the case where the movement being adopted is of a mechanical type. The per se known movement 5 has a pin 12 capable of assuming two axial positions. In one of these positions, the rotation of the pin causes the movement or displacement of the hands, and at the other position such a rotation serves for movement winding. The face dial is indicated at 50 and the hands at 51.

In this example, flexible button 40 is made slightly different than that previously described, except for its coupling to the bottom wall 3 of the case. Particularly, button 40 is provided with a peripheral bellows wall 41, the function of which is to allow both a compression of the button and a (limited) displacement thereof in direction C of FIG. 4. Internally of its bottom face 42, also has two parallel ribs 43 defining a gap 44, at midways the latter having a cross ridge 45.

The lower ends of two levers 17 and 18 are arranged within said gap 44 and under the action of a strong tension spring 19 are maintained in contact relationship with ridge 45.

Pin 12 has a threaded end length 13. A torsion spring 16 is slid by tight fit on pin 12 and has its end arm or portion hocked in a hole 46 of lever 18. Lever 18 is rotably mounted by a hole 23 on the stubbed or undercut portion 22 of a tubular member 14 which is internally threaded and screwed-down on length 13. This stubbed or undercut portion 22 also rotably carries the other lever 17 through a hole 24. By tight fit a torsion spring 15 is mounted on member 14 and its end arm or portion is hocked in a hole 47 of lever 17. Notches 20 and 21 are for hocking of spring 19. Levers 17 and 18 are identical to each other, but are mounted as reversed to each other. Spring 15 is effective as a unidirectional coupling, rotably driving said pin 12 when button 40 is depressed, while spring 16 is effective as a unidirectional coupling rotably driving pin 12 in the same direction when button 40 is allowed to move back to rest position.

The continued action of depressing and releasing button 40 causes a rocking motion of levers 17 and 18 in opposite directions and hence a rotation of pin 12 with accompanying movement winding. A forward or rearward displacement of button 40 in the direction of arrow C will cause an axial displacement of pin 12 through levers 17 and 18 and the steps between which such levers are arranged. Therefore, compression and release movements of the button will cause the displacement of the hands for time setting.

Figure 6:
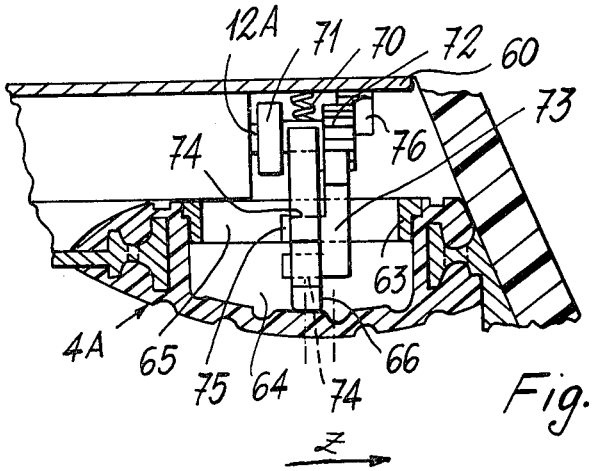
FIG. 6 is a fragmentary sectional view of the watchcase, in which a different mechanism for movement winding and time setting is mounted.
Figure 7:
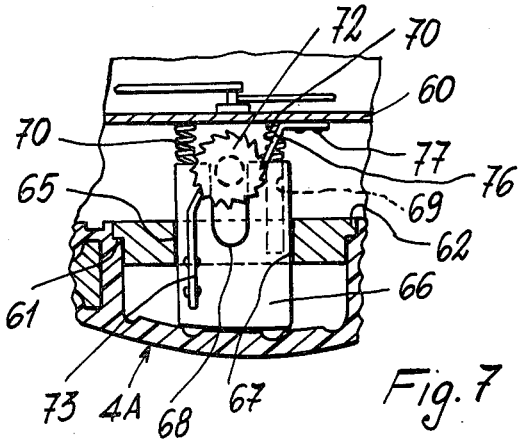
FIG. 7 is a fragmentary sectional view at 90° with respect to the sectional view of FIG. 6.

A further embodiment is shown in FIGS. 6 and 7.

The movement has a usual pin 12A capable of assuming two axial positions. At one of these positions, rotation of the pin causes the displacement of the hands, whereas at the other position the rotation serves for winding of movement 5A. The face dial is indicated at 60.

Button 4A is equivalent to button 4. It has a peripheral step 61 accomodating the contour flange 62 of a disc 63, which enters the button cavity or recess 64 and is provided with a rectangular window or slot 65. A metal key 66, guided along its longitudinal edges 67 by the opposite contours of window or slot 65, enters said recess or cavity 64. At the top and centrally said key 66 has a groove 68, wherein pin 12A is accommodated. At the groove sides two blind holes 69 are provided, such holes receiving compression springs 70, the other ends of which bear against face dial 60. Said springs tend to maintain the key in contact with the button. Key 66 is interposed between a flange 71 of pin 12A and a gear wheel 72 secured to the latter. A pawl 73 made of resilient sheet metal is for rotation of gear wheel 72 and is secured by two arms 74 thereof in holes of key 66. For attachment, the projecting ends 75 of arms 74 are folded or deformed.

A non return pawl 76 is secured to face dial 60, as by rivetting with two pins 77 secured to the face dial. The non return pawl acts upon gear wheel 72 and is of such a width as to operate on said gear wheel 72 at the two axial positions of the latter.

At the position shown in these figures of the drawings, the compression of button 4A causes the displacement of key 66 and accordingly the rotation of pin 12A, so that movement 5A is rewound. When releasing the button, the parts will return to the initial position under the bias of springs 70 without rotation of pin 12A.

By exerting through button 4A an axial push (arrow Z) on key 66, an axial displacement of pin 12A is provided. Whereupon, by exerting a compression on button 4A, pin 12 is rotated, providing the movement of the hands.

It is evident to one skilled in the art that other types of winding and time-regulating means could be envisioned for use in combination with the waterproof composite case itself.

For example, it is conveivable that, due to the low cost of the case assembly and to the availability of small batteries having extremely long lives, a watch could be constructed which could be discarded after the battery, is discharged. In such watch, no winding would be necessary and the time-selecting could be effected by an electrical contact located under the button and activated by depressing same.

Samples of composite watch cases of the present invention were tested.

In the tests, the samples in question are immersed in an acqueous liquid contained in a transparent container. The latter is closed and the liquid is compressed while at the same time the pressure values are measured.

In the case of liquid leakage into the case, the test is stopped and the pressure at which penetration of the liquid into the case begins is ascertained.

Generally a case which withstands a pressure over 2 $kg/cm^2$, equal to a 20 m water column, is considered liquid proof.

EXAMPLE 1

Samples were prepared by first injection molding the transparent section from polymethyl methacrylate (PMMA) having a degree of fluidity (ASTM-D 138; 230° C.; $\phi$2.1 mm) comprised between 2.5 and 6 g/10 min. and a fluidity index (ASTM-D 569) (Method A) comprised between 147° and 152° C.

There is then overmolded on said transparent portion the actual body portion which thus surrounds and retains the border portion of the transparent section, forming a single integral piece without break of continuity. The pigmented PPMA used for the production of the opaque body portion has the same characteristics as the PPMA used for the transparent portion.

Similarly the case bottom was prepared from the pigmented PPMA.

For the production of the flexible button there was used a thermoplastic polyester elastomer having an excellent resiliency and resistance to break on flexure. The shore hardness (ASTM D-2240) is of 92 A/40D points and the flexure modulus (ASTM D-790) near to 500 $Kg/cm^2$.

The hermetic closing of the case was achieved by ultrasonically welding the bottom to the body portion. After repeated leakage proofs, conducted on a large number of samples, there was ascertained the absolute impermeability of the case produced as described up to pressures of 4 $Kg/cm^2$.

EXAMPLE 2

On the same plastic crystal as in Example 1 there was superstamped the body prepared using an acrylonitrile-butadiene-styrene (ABS) copolymer instead of the PMMA.

The bottom, on which there was overmolded a flexible button produced from the thermoplastic copolyester copolymer as in Example 1, was prepared from the same ABS copolymer.

When subjected to a pressure in excess of 4 $Kg/cm^2$, no leakages were noted in the prototypes.

EXAMPLE 3

As in the preceding example, there were used the plastic crystals of Example 1 on which there was overmolded a body prepared from an acetal copolymer. The fluidity of the product chosen had an index of 27 g/10 min. (190° C. and $\phi$2 min.).

Following the precedure outlined in Example 1, there was also prepared the case bottom in polyacetal copolymer with the flexible bottom in polyurethane elastomer.

These samples also superated the leakage test conducted at a pressure of 4 $Kg/cm^2$.

Table I, which follows sets forth the average operating conditions for the molding of the various materials used in the preparation of the samples utilized in the tests outlines before.

While the present description defines the invention, it will be obvious to one skilled in the art that certain modifications may be made without departing from the scope of the invention. For example, the flexible button 4 may be located on the side of body 2 rather than on bottom 3. This will, of course, necessitate changes in the configuration and physical characteristics of the winding and time-selecting assembly.

TABLE I

AVERAGE OPERATING CONDITIONS FOR THE MOLDING OF THE VARIOUS MATERIALS

| CONDITIONS | UNITY OF MEASURE | PMMA | POLYESTER ELASTOMER | ABS | ACETAL COPOLYMER | POLYURETHANE ELASTOMER |
|---|---|---|---|---|---|---|
| INJECTION PRESSURE: - SCREW PRESS | $Kg/cm^2$ | 1000–1200 | 1000 | 1000–1200 | 1400 | 1000 |
| Temperature feeding zone | °C. | 150–180 | 170 | 160 | 160 | 130 |
| Temperature of compression | °C. | 180–210 | 180 | 200 | 190 | 180 |
| Temperature before the nozzle | °C. | 210–240 | 205 | 230 | 220 | 205 |
| Temperature at the nozzle | °C. | 205–235 | 200 | 220 | 210 | 195 |
| Temperature of the mold | °C. | 70–80 | 20 | 80 | 80 | 20 |
| Curing temperature after molding | °C. | 70 max | — | — | — | — |
| Schrinkage in respect to the mold | % | 0,2–0,6 | 0,2–1 | 0,4–0,6 | 1,5–2,5 | 0,2–1 |

What I claim is:

1. A hermetically closed watch comprising a case of plastic material including:

a substantially rigid transparent portion fast with a substantially rigid first portion of the case;

a substantially rigid second portion sealable to said first portion and closing said first portion; and at least one flexible zone for controlling at least the time setting of the watch movement, wherein said flexible zone comprises a membrane button of flexible plastic material fast with and overmolded to said case, said membrane button closing an opening of said second portion and having loop-shaped edges enclosing the inner and outer contours of the opening provided with annular ridges, said edges being joined by beads of plastic material flown into a plurality of holes passing through said contours.

2. A watch according to claim 1, further comprising a movement drive shaft and a drive mechanism associated therewith, said drive shaft and mechanism being within the case, said mechanism being controlled through said membrane button and suitable to convert a reciprocating motion into a rotary motion of said shaft.

3. A watch according to claim 1, wherein the transparent portion of the case peripherally has at least one annular groove, into which the material of the first case portion penetrates.

4. A watch according to claim 1, wherein the peripheral contour of the lower face or side of the case is shaped, so that the flexible button will not contact the user's wrist.

5. A watch according to claim 2, wherein said drive mechanism comprises a key slidably straddling the drive shaft and having a pawl acting upon a gear wheel mounted on the drive shaft.

* * * * *